US005575326A

United States Patent [19]

Asami et al.

[11] Patent Number: 5,575,326

[45] Date of Patent: Nov. 19, 1996

[54] INDOOR UNIT OF AIR CONDITIONER

[75] Inventors: Yasutoshi Asami, Tokyo; Isao Kawasaki, Yokohama, both of Japan

[73] Assignee: Fujitsu General Limited, Japan

[21] Appl. No.: 262,943

[22] Filed: Jun. 21, 1994

[30] Foreign Application Priority Data

Aug. 6, 1993 [JP] Japan ..... 5-196151

[51] Int. Cl.[6] ..... F28F 13/12

[52] U.S. Cl. ..... 165/124; 165/122; 165/151

[58] Field of Search ..... 165/122, 124, 165/151; 62/263

[56] References Cited

U.S. PATENT DOCUMENTS

| | | | |
|---|---|---|---|
| 4,313,493 | 2/1982 | Kawase et al. | 165/122 |
| 5,060,720 | 10/1991 | Wollaber et al. | 165/122 |
| 5,174,366 | 12/1992 | Nagakura et al. | 165/151 X |
| 5,211,219 | 5/1993 | Kawabata et al. | 165/122 |
| 5,388,426 | 2/1995 | Wada et al. | 62/263 |

FOREIGN PATENT DOCUMENTS

| | | | |
|---|---|---|---|
| 547450 | 6/1993 | European Pat. Off. | 165/122 |
| 35771 | 8/1982 | Japan . | |
| 161622 | 9/1984 | Japan | 165/122 |
| 128038 | 6/1986 | Japan | 165/122 |
| 181722 | 8/1991 | Japan | 165/53 |
| 68921 | 6/1992 | Japan | 165/122 |
| 8316 | 2/1993 | Japan | 165/122 |

*Primary Examiner*—Leonard R. Leo
*Attorney, Agent, or Firm*—Adams & Wilks

[57] ABSTRACT

A compact indoor air conditioner may be produced by mounting a fan unit within the installation space of a heat exchanger inside the housing of the air conditioner. An air conditioner having such structure comprises a housing comprising a frame body, a front cover attached to the front of the frame body and having air inlets in the upper surface and in the front and an air outlet in the front lower part, a suction grille that is attached detachably to the front cover and which can be opened or closed, a heat exchanger disposed in the housing and having two cut-out portions defining an upright section, a rearward inclined section and a forward inclined section, wherein the rearward inclined section and the forward inclined section comprise the upper part of the heat exchanger and have an inverted V-shape, and a fan disposed rearward of the upright section and rearward inclined section of the heat exchanger.

2 Claims, 5 Drawing Sheets

INDOOR UNIT OF AIR CONDITIONER

FIELD OF THE INVENTION

The present invention relates to an indoor unit of an air conditioner, and more particularly to an air conditioner indoor unit that is small-sized and can be cleaned easily.

DESCRIPTION OF THE PRIOR ART

In recent years, even in private houses, interior decoration has come to be considered important, and in the case of indoor units of air conditioners, it is strongly demanded that the unit not only have the basic function of air conditioning but also be more compact and have an appearance suitable for the interior.

Thus, to meet these demands, for example, Japanese Utility Model Application Publication No. 57-35771 issued on Aug. 7, 1982 is suggested. As is shown in FIG. 5, a case 51 of an indoor unit of an air conditioner disclosed therein comprises a frame body 52 and a front cover 53 mounted to the front of the frame body 52. An upper part of the basket case 31 is formed with an air inlet 54. In an upper part of an air passage 56 that connects the air inlet 54 to an air outlet 55 formed in a lower part of the case 51, a heat exchanger 57 in the shape of an inverted V is disposed, and below the heat exchanger 57, a fan 58 is disposed. Below the air inlet 54 and along the inner surface of the case or basket 51, an air filter 59 for catching dust in the room is detachably provided, and in the air outlet 55, louvers 60 for adjusting the direction of the wind into the room are provided.

However, in such a conventional indoor unit of an air conditioner, since the heat exchanger 57 is formed into an inverted V, the case or vertical size of the basket 51 can be made small in comparison with the upright type heat exchanger used previously, but since the fan 58 is disposed below the lower end of the heat exchanger 57, it is required that the vertical size of the basket 51 is at least larger enough to accommodate the heat exchanger 57 and the fan 58 vertically, resulting in a limitation on the minimum size of the basket 51, and therefore the basket cannot be made sufficiently small-sized. Further, since the front cover 53 is fixed to the body frame 52 directly by screws or the like, the front cover 53 cannot be detached easily and therefore there is a problem that when the front of the basket is soiled, it cannot be cleaned easily, for example, by washing with water.

SUMMARY OF THE INVENTION

The present invention provides an indoor unit of an air conditioner that is intended to make the basket of the indoor unit of the air conditioner small-sized and easy to be cleaned.

The present invention comprises a case or basket having at least air inlets in the upper surface and an air outlet in the front lower part, a heat exchanger that is disposed in an air passage connecting said air inlets of said basket to said air outlet and which has two cuts so as to form an upright section and a rearward inclined section located forward and a forward inclined section located rearward that are folded in three, said rearward inclined section and said forward inclined section forming the upper part of the heat exchanger into the shape of an inverted V, and a fan disposed rearwardly of the upright section and the rearward inclined section of said heat exchanger.

The case or basket comprises a frame body, a front cover attached to the front of said frame body and having air inlets in the upper surface and in the front upper part and an air outlet in the front lower part, and a suction grille that is detachably connected to said front cover and can be opened or closed.

Further, bearings are formed at the opposite sides of the upper surface front edge of the front cover constituting said basket, catchers are disposed at the opposite sides of the front lower part of said front cover, shafts that are supported rotatably by said bearings are formed at the opposite sides of the upper end of said suction grille, projections that are detachably supported by said catchers are formed at the opposite sides of the lower part of said suction grille, and when said shafts of said suction grille are allowed to be borne by said bearings of said front cover and said projections of said suction grille are allowed to be held by said catchers of said front cover, said suction grille is mounted to the front of said front cover, and the projections of said suction grille are released from said catchers of said front cover. Further, when said suction grille is lifted up and the shafts are released from the bearings of said front cover, said suction grille can be removed from said front cover.

Further, recesses are formed in the opposite sides of the front upper part, arms are movably supported in said recesses and are normally energized by springs in the opening direction, when the projections of said suction grille are released from said catchers of said front cover, said suction grille is opened by the energized force of said arms and said suction grille is held in a prescribed open position, and further when said suction grille is lifted up to release the shafts from the bearings of said front cover, said suction grille can be removed from said front cover.

In accordance with this construction, since a heat exchanger is arranged in an air passage connecting air inlets of a basket to an air outlet of the basket and has two cuts to be folded in three portions with the upper forward part and upper rearward part thereof forming the shape of an inverted V and a fan is arranged in the rear of the upright portion of said heat exchanger, the vertical size of the basket can be made as small as possible. The basket comprises a frame body, a front cover that is attached to the frame body and has air inlets in the upper surface and front upper part and an air outlet in the front lower part, and a suction grille attached to the front of said front cover and when the suction grille is opened, filters attached to the front upper part of the front cover can be changed, and when the opened suction grille is lifted up, the front cover can be removed easily and can be cleaned, for example, by washing with water.

DESCRIPTION OF A PREFERRED EMBODIMENT

Figure 1:
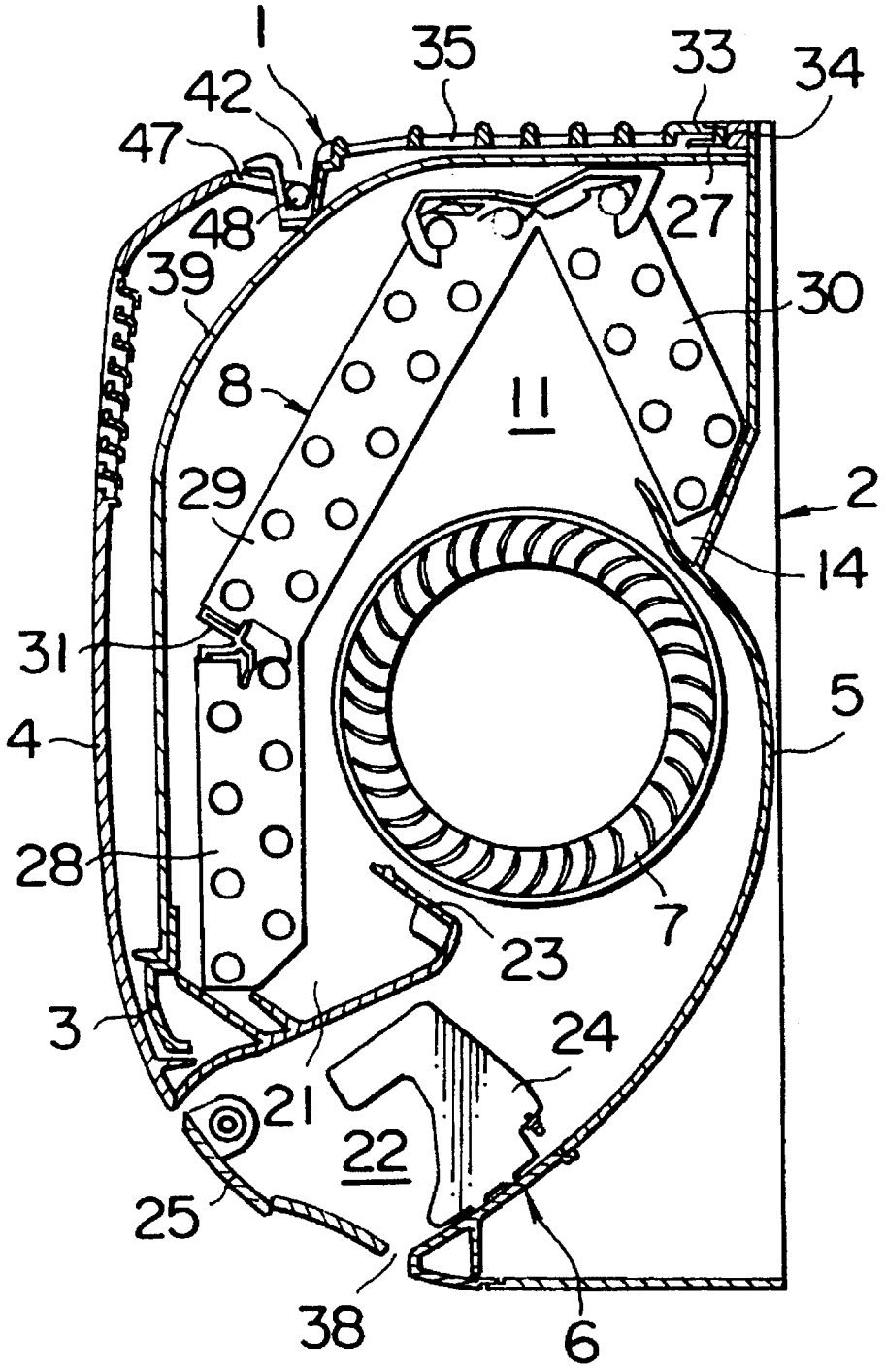
FIG. 1 is a schematic cross-sectional view of an indoor unit of an air conditioner according to the present invention.
Figure 2:
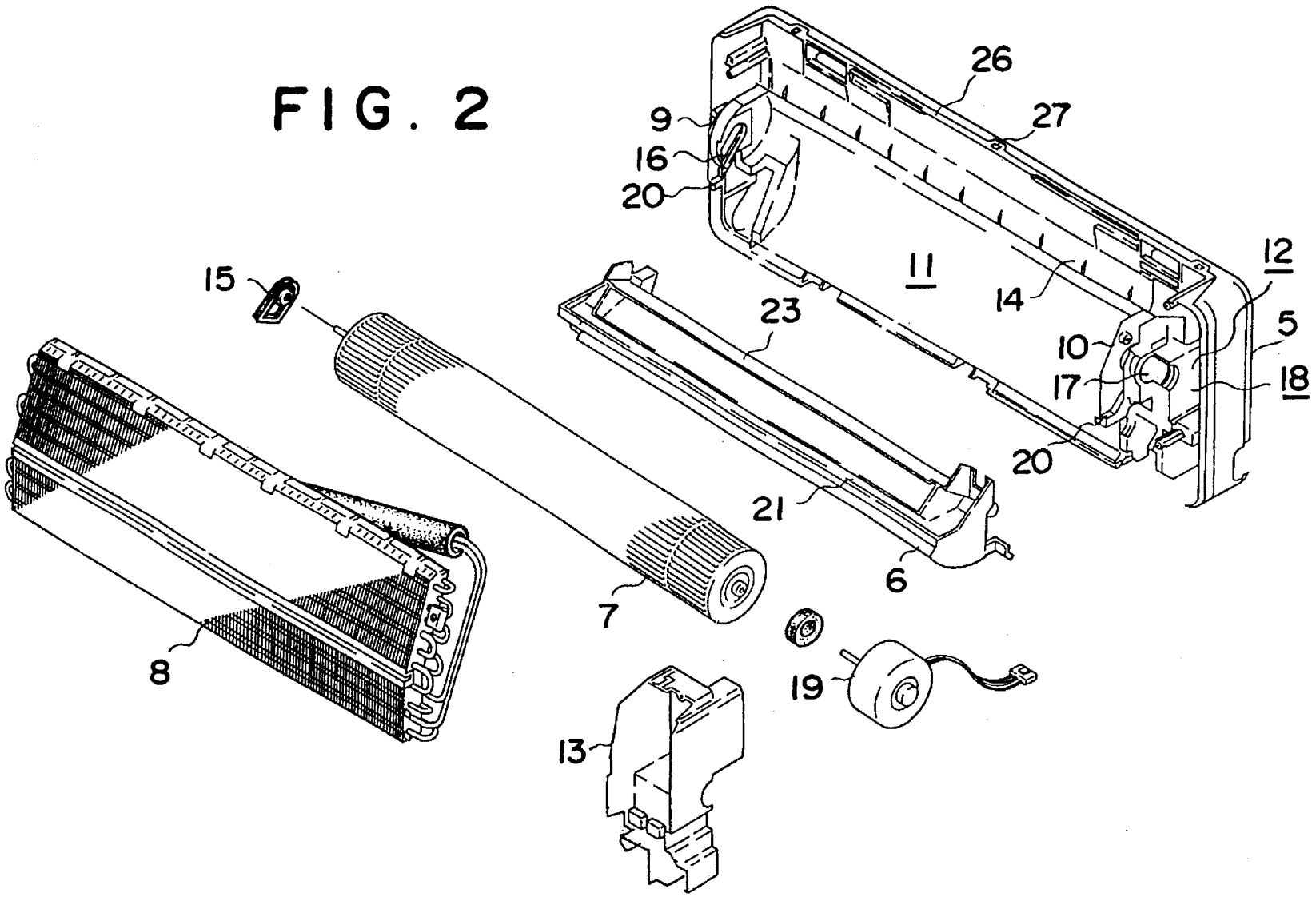
FIG. 2 is an exploded perspective view of a frame body that constitutes the case of the indoor unit of an air conditioner according to the present invention.

Referring to the drawings, an embodiment of the present invention is described. As is shown in FIG. 1, a basket 1 of this indoor unit comprises a frame body 2 formed to be suited to a wall type, a front cover 3 for covering the front of the frame body 2, and a suction grille 4 that covers detachably the front of the front cover 3 and can be opened or closed. The frame body 2 is made up of an upper frame 5 and a lower frame 6 that are divided below a fan 7. As is shown in FIG. 2, the upper frame 5 is formed with an air passage chamber 11 in association with a heat exchanger 8. A pair of a left plate 9 and a right plate 10 are provided to define the air passage chamber 11 and a control chamber 12. In the control chamber 12, an electric equipment box 13 is housed. A dew condensation groove 14 for dew condensation from the heat exchanger 8 is formed integrally with the back of the upper frame 5 between the side plates 9 and 10. The side plate 9 is provided with a groove 16. The groove 16 supports a bearing 15 for resiliently supporting one of the rotating shafts of the fan 7. Said plate 10 is provided with an insertion hole 17 through which the other rotating shaft of the fan 7 is inserted. The side of said side plate 10 where said control chamber 12 is situated and the side surface of the upper frame 5 cooperate to form a motor housing chamber 18 for housing a motor 19 for driving the fan 7. Grooves 20 for guiding the dew condensation from said dew receiving tray 21 14 to the below mentioned dew receiving groove are provided outside said side plates 9 and 10.

On the other hand, the lower frame 6 has a dew receiving tray 21 for receiving dew condensation from said heat exchanger 8 and an air passage chamber 22 below the dew receiving tray 21 and in communication with said air passage chamber 11. The rear end of said dew condensation receiving tray 21 is formed with a stabilizer 23 for said fan 7. In the rear of the air passage chamber 22, left and right deflecting plates 24 are provided for deflecting the outlet wind direction to the right or the left. In front of said dew receiving tray 21, upper and lower wind direction plates 25 are provided for deflecting the outlet wind direction upward and downward and are divided into two. These wind direction plates 24 and 25 are attached integrally with the lower part of said frame 5, for example, by screws (not shown). The dew receiving tray 21 is disposed below said side plates 9 and 10 so that the dew condensation from said groove 20 may be received thereby. Thus, said bearing 15 is secured firmly in the groove 16. The motor 19 is secured firmly in the motor housing chamber 18 by attaching the electronic equipment box 13 in the control chamber 12, for example, by screws (not shown). By connecting the other rotating shaft of the fan 7 and the rotating shaft of the motor, the fan 7 is rotatably supported. The front upper part of the thus formed frame body 2 above the dew receiving tray 21 and the lower part of the frame body 2 below the dew receiving tray 21 are open, the upper surface of the frame body 2 is opened by the formation of a notch 26, and the rear edge of the notch 26 is provided with a plurality of anchoring holes 27. As is shown in FIG. 1 in detail, the heat exchanger 8 has two cuts so as to have an upright section 28 and a rearward inclined section 29 located forward and a forward inclined section 30 located rearward that are folded in three portion, and said rearward inclined section 29 and the forward inclined section 30 form the upper part of the heat exchanger 8 into the shape of an inverted V. Further, the heat exchanger 8 is attached firmly to the upper frame 5, for example, by screws (not shown) so that the lower end of the upright section 28 may be located over said dew receiving tray 21 and the lower end of the forward inclined section 30 may be located over said dew receiving groove 14. Thus, the fan 7 is disposed in the rear of the upright section 28 and the rearward inclined section 29 of the heat exchanger 8. In the space between the upright section 28 and the rearward inclined section 29, a wind shield plate 31 is attached to shield the space, so that the suction air will not pass through the space.

Figure 3:
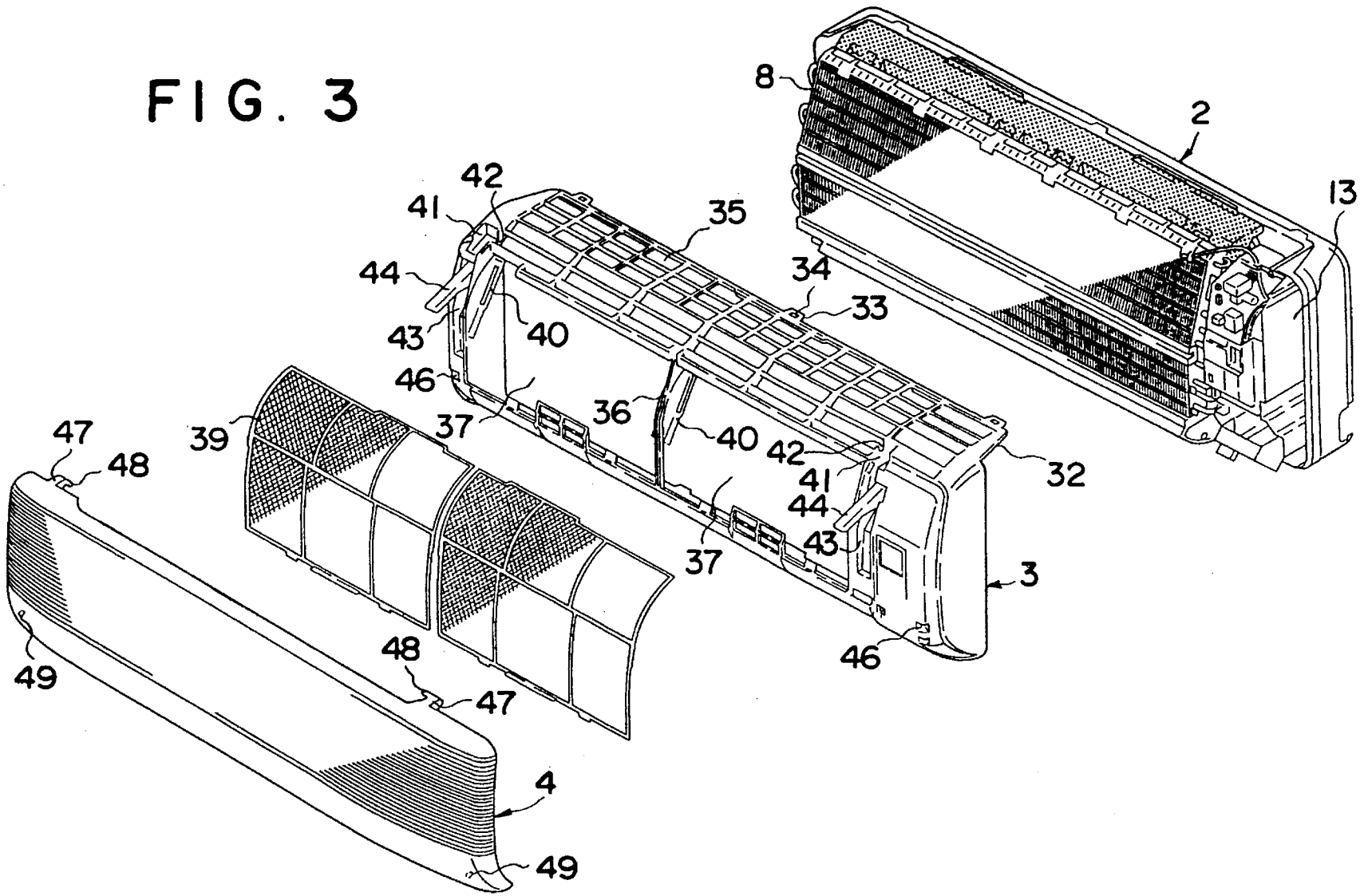
FIG. 3 is an exploded perspective view of the indoor unit of an air conditioner according to the present invention.

As is shown in FIG. 3 in detail, the front cover 3 is formed in the shape of a box with the back open and the upper surface of the front cover 3 is provided with a projected extending section 32 in conformity with the notches 26 formed in the upper frame 5. The rear end of the extending section 32 is provided with projections 33 having tabs 34 that can be fitted in anchoring holes 27 formed in corresponding projections formed in the upper surface of the frame body 2. The upper surface of the front cover 3 including the extending section 32 is formed provided with air inlets 35 forming a lattice and the front upper part has a strut 36 at the center thereof so that left and right air inlets 37 may be provided. The front lower part of the unit is provided with an air outlet 38 in conformity with said air passage chamber 22. Inside said air inlets 35 and 37, two air filters 39 are attached detachably by guides 40 located on the opposite sides of said strut 36 and on the edges of the openings of the air inlets 37. The thus formed front cover 3 is used to cover said frame body 2 and is attached firmly to said frame body 2, for example, by using screws (not shown). Then, the tabs 34 of the projections 33 situated at the rear end of said extending section 32 are fitted in said anchoring holes 27. On the other hand, the opposite sides of the upper front edge of the front cover 3 are provided with stepped recesses 41, and inside thereof, bearings 42 are provided continuously therewith. The opposite sides of the front upper part are provided with recesses 43, and arms 44 are movably situated in the recesses 43 with one end of each of the arms 44 pivotally supported and are energized by springs 45 normally in the opening direction. The opposite sides of the front lower part are provided with catchers 46. When projections described later are inserted into the catchers 46, the catchers 46 hold the projections, and when the catchers 46 are pushed with the catchers 46 holding the projections, the catchers 46 release the projections.

Figure 4:
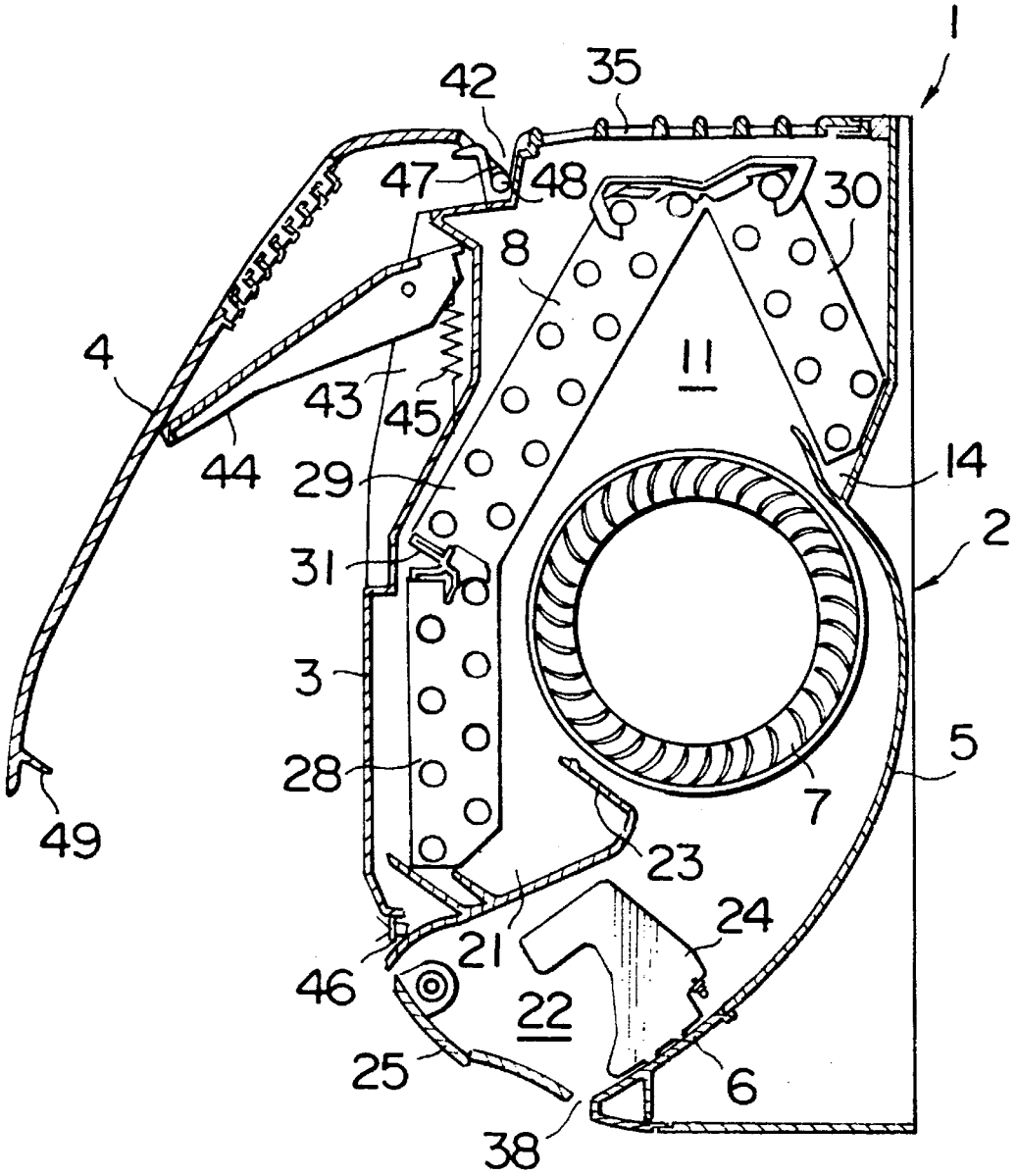
FIG. 4 is a schematic cross-sectional view of the indoor unit of an air conditioner according to the present invention with the suction grille being opened.
Figure 5:
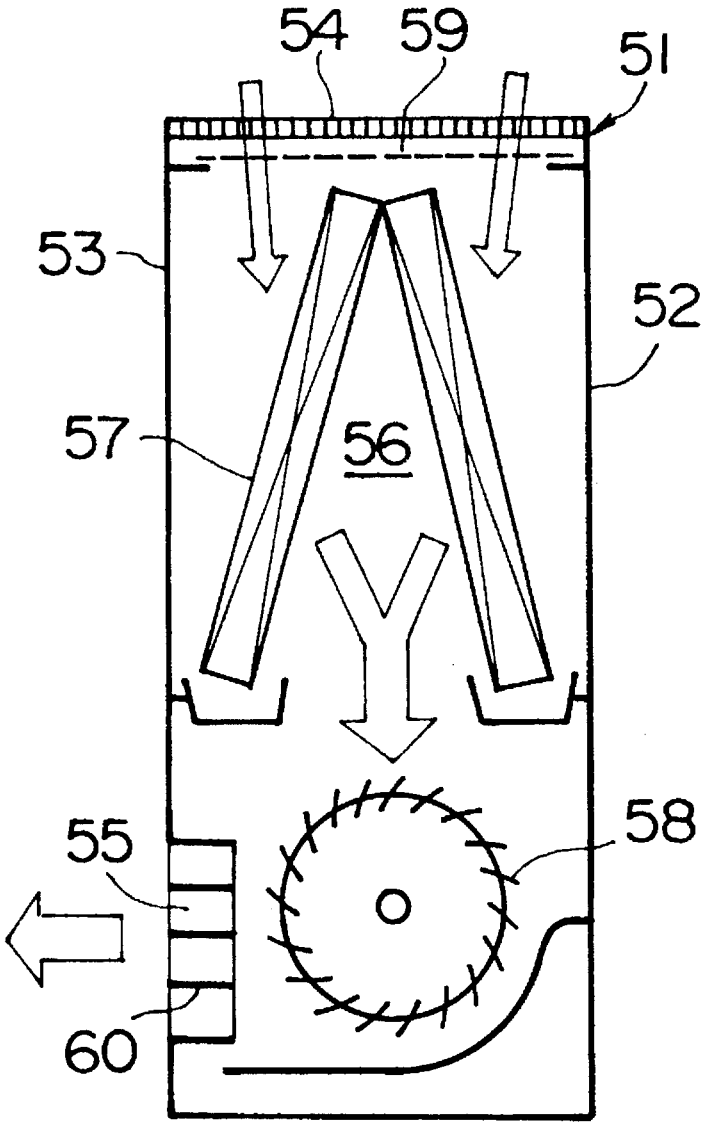
FIG. 5 (PRIOR ART)
FIG. 5 is a schematic cross-sectional view of an example of a prior indoor unit of an air conditioner.

As is shown in FIG. 3 in detail, the suction grille 4 is in the shape of a tray, the opposite sides of the upper end thereof are provided with projections 47 that will be received in said stepped recesses 41, and a shaft 48 that will be borne on said bearing 42 is formed integrally with the inside of each projection 47. Projections 49 are situated on the back of the lower opposite sides thereof in positions to correspond to said catchers 46 and can be supported detachably by the catchers 46. The projections 47 are inserted in the stepped recesses 41 and the shafts 48 situated at the ends thereof are fitted in the bearings 42. The suction grille 4 is turned about the bearings 42 and then said projections 49 are held by said catchers 46, so that the suction grille 4 is attached firmly to the front of the front cover 3. When it is desired to remove the suction grille 4, the lower opposite sides of the suction grille 4 are pressed to release the projections 49 from the catchers 46 and then the suction grille 4 is turned upward about the bearings 42 by the energized force of the arms 44 and is held in the opened position shown in FIG. 4. Then, the suction grille 4 is lifted up to release the shafts 48 from the bearings 42, so that the suction grille 4 can be removed from the front cover 3.

In this embodiment, the arms 44 are provided at the opposite sides of the front upper part of the front cover 3. The arms 47 function to support the suction grille 4 in a prescribed opened position, and are particularly convenient when the air filters 39 are changed, but they are required to be not necessarily required for opening and closing and attaching and detaching the suction grille 4 and are optionally chosen.

What is claimed is:

1. An air conditioner comprising: a casing having at least one air inlet in an upper surface thereof and at least one air outlet in a front lower part; a heat exchanger disposed in an air passage connecting the at least one air inlet of the casing to an air outlet and being bent about two cut-out portions therein so as to have an upright section and a rearward inclined section located forward and a forward inclined section located rearward, the rearward inclined section and the forward inclined section forming the upper part of the heat exchanger into the shape of an inverted V; and a fan disposed rearward of the upright section and the rearward inclined section in an installation space of the heat exchanger; wherein the casing comprises a frame body, a front cover attached to the frame body and having the at least one air inlet in an upper surface and in a front upper part thereof and the at least one air outlet in a lower part, a suction grille attached detachably to the front cover and which can be opened or closed; bearings formed at opposite sides of an upper surface of the front cover, catchers disposed at opposite sides of a lower part of said front cover, shafts supported rotatably by said bearings formed at opposite sides of an upper end of said suction grille, protections detachably supported by said catchers formed at opposite sides of a lower part of said suction grille, such that when said shafts of said suction grille are supported by said bearings of said front cover and said projections of said suction grille are held by said catchers of said front cover, said suction grille is mounted to the front of said front cover, and when the projections of said suction grille are released from said catchers of said front cover, said suction grille is lifted up, and the shafts are released from the bearings of said front cover, said suction grille can be removed from said front cover, the casing further comprising recesses formed in opposite sides of a front upper part of the front cover, arms movably supported in said recesses and which are normally biased by springs in an opening direction, such that when the projections of said suction grille are released from said catchers of said front cover, said suction grille is opened by said arms and said suction grille is held in a prescribed open position, and when said suction grille is held in a prescribed open position and is lifted up to release said shafts from said bearings of said front cover, said suction grille is removed from said front cover.

2. An air conditioner comprising: a casing having at least one air inlet and one air outlet and defining an air passage chamber connecting the at least one air inlet and the at least one air outlet; a heat exchanger disposed in the air passage chamber and being bent about two cut-out portions therein so as to have an upright section, a rearwardly inclined section and a forwardly inclined section, the rearwardly inclined section and the forwardly inclined section forming the upper part of the heat exchanger in an inverted V-shape; a fan disposed rearward of the upright section and the rearwardly inclined section within an installation space of the heat exchanger; wherein the casing comprises a frame, a front cover attached to the frame and having the at least one air inlet in an upper surface thereof and the at least one air outlet in a lower part, a suction grille detachably connected to the front cover and which can be opened or closed, bearings formed at opposite sides of an upper surface of the front cover, catchers disposed at opposite sides of a lower part of the front cover, shafts rotatably supported by the bearings formed at opposite sides of an upper end of the suction grille, protections detachably supported by the catchers formed at opposite sides of a lower part of the suction grille, such that when the shafts of the suction grille are supported by the bearings of the front cover and the projections of the suction grille are releasably held by the catchers of the front cover, the suction grille is mounted to the front of the front cover, and when the protections of the suction grille are released from the catchers of the front cover, the suction grille is lifted up and the shafts are released from the bearings, the suction grille may be removed from the front cover, the casing further comprising recesses formed in opposite sides of the front of the front cover and arms movably supported in the recesses and normally biased by springs in an opening direction, such that when the projections of the suction grille are released from the catchers of the front cover the suction grille is opened by the arms and held in an open position, and the suction grille may be manually lifted to release the shafts from the bearings of the front cover to remove the suction grille from the front cover.

* * * * *